US005914190A

United States Patent [19]

Withiam et al.

[11] Patent Number: 5,914,190

[45] Date of Patent: Jun. 22, 1999

[54] METHOD ABD PREPARATION OF PIGMENTED PAPER FIBERS AND FIBER PRODUCTS

[75] Inventors: Michael C. Withiam, Landenberg, Pa.; Donald P. Conley, Conowingo, Md.

[73] Assignee: J.M. Huber Corporation, Edison, N.J.

[21] Appl. No.: 08/856,824

[22] Filed: May 15, 1997

Related U.S. Application Data

[62] Division of application No. 08/444,105, May 18, 1995, abandoned.

[51] Int. Cl.[6] ..... D21H 23/24

[52] U.S. Cl. ..... 428/372; 162/181.1; 162/182; 162/183; 162/185

[58] Field of Search ..... 162/141, 181.1, 162/181.2, 181.3, 181.4, 159, 182, 183, 185, 209; 428/372

[56] References Cited

U.S. PATENT DOCUMENTS

| | | | |
|---|---|---|---|
| 5,030,284 | 7/1991 | Withiam | 106/409 |
| 5,122,230 | 6/1992 | Nakajima . | |
| 5,127,994 | 7/1992 | Johansson | 162/185 |
| 5,149,400 | 9/1992 | Haase et al. | 162/181 |
| 5,275,699 | 1/1994 | Allan et al. . | |
| 5,665,205 | 9/1997 | Srivatsa et al. . | |
| 5,695,609 | 12/1997 | Petander et al. . | |
| 5,755,871 | 5/1998 | Husson, Sr. . | |

FOREIGN PATENT DOCUMENTS

| | | |
|---|---|---|
| 0372715B1 | 4/1994 | European Pat. Off. . |
| 1107341 | 3/1968 | United Kingdom . |
| WO9636750 | 11/1996 | WIPO . |

*Primary Examiner*—William Krynski
*Assistant Examiner*—J. M. Gray

[57] ABSTRACT

Pigmented paper fibers of improved brightness and light scattering ability are produced by treating the pulp fibers with 0.1 to about 10 wt. % of a silica/alumina sulfate sol composition at a temperature of about 50 to 80° C. and good agitation.

5 Claims, No Drawings

METHOD ABD PREPARATION OF PIGMENTED PAPER FIBERS AND FIBER PRODUCTS

This application is a division of application Ser. No. 08/444,105 filed May 18, 1995 which application is now: abandoned.

TECHNICAL FIELD

This invention relates to a method for the production of an improved and differentiated paper fiber by physical adsorption of pigment particles thereon, and more particularly relates to a process for treating paper fibers with alumina and silica/alumina compounds to produce a pigmented fiber having improved brightness and light scattering ability.

BACKGROUND ART

The paper industry invests substantial effort to improve fibers and particularly to improve the brightness and light scattering ability of fibers. Conventionally, paper pulps are whitened by chemical bleaching methods. Paper pulp also contains various fillers and additives to enhance properties of the paper. The present invention provides a procedure by which brightness and light scattering ability of the fiber can be improved by addition of a silica/alumina additive. The present invention thus provides a method to brighten paper without the use of chlorine or peroxide chemical bleaching systems which often have a negative effect on opacity as brightness is increased.

SUMMARY OF THE INVENTION

It is accordingly one object of the present invention to provide an improved method for producing pigmented paper fibers which have improved brightness and light scattering ability.

A further object of the invention is to provide a method to produce pigmented paper fibers which have improved brightness and light scattering ability, and provide pigmented paper fibers which have improved characteristics by treatment with a silica/alumina sulfate sol composition.

Other objects and advantages of the present invention will become apparent as the description thereof proceeds.

In satisfaction of the foregoing objects and advantages, the present invention provides an improved pigmented paper fiber, said paper fiber having improved brightness and light scattering ability, and characterized as comprising a pulp fiber which has been reacted with 0.1 to 10% by weight of a silica/alumina sulfate sol compound.

In a further embodiment, the present invention provides a method for the production of a pigmented paper fiber having improved brightness and light scattering ability, the method comprising:

(a) forming a silica/alumina sulfate sol (SASS) composition;

(b) adding said silica/alumina sulfate sol composition to a slurry of paper fibers maintained at a temperature of about 30 to 80° C. with sufficient agitation to disperse the sol into the slurry;

(c) providing sufficient time for pigment deposition; and (d) recovering the pigmented fiber.

BRIEF DESCRIPTION OF THE DRAWINGS

Reference is now made to the drawings accompanying the application wherein:

FIGS. 1 and 2 are SEM photographs of pigmented fibers of the invention.

DESCRIPTION OF THE INVENTION

The present invention relates to improved paper fibers and an improved method to produce differentiated paper fibers by the physical absorption of pigment particles onto the paper fiber surfaces. The present invention provides a method by which pigmented fibers can be produced which have improved brightness and light scattering ability, and the improved brightness and superior light scattering ability appears directly related to the presence of the pigment. The products appear unique in that the pigment particles are attached directly to individual fibers and are also found among groups of fibers. Accordingly, the present invention provides a novel method for producing pigmented fibers and also provides novel pigmented fibers having improved characteristics.

The paper fibers to be treated according to the invention are paper fibers of any type, but bleached kraft fibers are preferred. The fibers may be treated in a pulp mill or any paper mill environment. The method of the invention provides an alternative to chlorine or peroxide chemical bleaching systems which have a negative impact on opacity as brightness is increased. In the present invention, there is no substantial adverse effect on opacity and brightness and light scattering ability are enhanced by treatment of the fibers with the pigments of the invention.

The pulp fibers are treated with SASS at ranges of from about 0.1 to 10% of the SASS pigment based on the weight of the pulp fibers to be treated (dry wt./dry wt.). The fibers are usually contained in a conventional aqueous slurry of the type well known to the paper art. Treatment of the pulp fibers with the SASS results in a gain of as much as 7 points in pulp brightness and a moderate gain in opacity. However, a more practical gain is 2–3 points of pulp brightness.

The compositions used to treat the paper pulp compositions are of the type described in U.S. Pat. Nos. 5,030,284, 5,149,400, and published European Patent Specification 0,372,715, the entire disclosures which are incorporated herein by reference. These compositions are polymerized silica alumina sulfate compounds of a type which will hydrolyze in the pulp fiber aqueous medium to liberate an alumina or alumina/silica compound which will nucleate or deposit on or among the pulp fibers. The resultant pulp fiber product comprises pulp fibers having nucleated in or deposited thereon alumina or alumina/silica compounds from the compositions.

The silica alumina sulfate compounds (SASS) are of the following composition.

$xR:Al_2O_3:ySiO_2:zSO_4:pH_2O$ where R is an alkali metal oxide or an alkaline earth metal oxide, preferably $Na_2O$ or mixture thereof, and

| | | |
|---|---|---|
| x = 0 | to | 2.00 |
| y = 0.001 | to | 1.00 |
| z = 0 | to | 20.00 |
| p = 0 | to | 100 |

Preferred compounds include the following composition range:

| | | |
|---|---|---|
| x = 0 | to | 1.10 |
| y = 0.03 | to | 3.40 |
| z = 1.5 | to | 3.2 |
| p = 4 | to | 100 |

The alumina-silica sulfate compositions useful as pigments as described in U.S. Pat. No. 5,030,284 are alumina-silica-sulfate compositions containing a bound sulfate network within the composition having the formula:

$xR:Al_2O_3:ySiO_2:zSO_4:pH_2O$ wherein

R is selected from the group consisting of alkali metal oxides, alkaline earth metal oxides, transition metals capable of forming sulfate salts and mixtures thereof; and wherein x is about 0.001 to 0.5;

y is about 0.01 to 3.00;

z is about 0.01 to 3.00; and p is about 0. to 100.00.

The alumina-silica-sulfate must be in the form of a colloidal sol. The sulfate in the composition is in the form of bound sulfate.

As described in European Application No. 0 372 715 and U.S. Pat. No. 5,149,400, the compositions are indicated as being "polynucleate aluminum hydroxy silica-sulphate" compounds (PASS) having the following average composition:

$xR:Al_2O_3:ySiO_2:2pH_2O$ wherein y is 0 to 1.0, preferably, 0.3 to 0.7 y is 0 to 0.5, preferably, 0.01 to 0.12 z is 1.0 to 3.0, preferably, 2.0 to 2.5 p is 4.0 to 100, preferably, 4.0 to 50

The preferred compositions of the alumina-silica-sulfate composition useful in this invention are alumina-silica sulfate compositions having the formula:

$xR:Al_2O_3:ySiO_2:zSO_4:pH_2O$ wherein x is about 0.5 to 3.5 y is about 0.05 to 1.5 z is about 2 to 3 p is above 4.0

In conducting the method of the invention, a slurry of paper fibers is provided, which slurry will have a conventional consistency as is well known in the paper art. The pulp slurry is brought to a temperature in the range of about 30 to 80° C., preferably about 60 to 65° C. with sufficient agitation so that the silica/alumina sulfate compound will be dispersed thoroughly throughout the pulp fibers. The silica/alumina sulfate compound is added to the pulp slurry in an amount of about 0.1 to 10% (dry wt/dry wt), preferably about 0.1 to 0.5% (dry wt/dry wt), based on the weight of the pulp fibers to be treated. Agitation is continued to thoroughly disperse the compound into the slurry. After addition of the pigment, the resulting reaction mixture is digested by maintaining agitation for about 5 minutes to about 2 hours at the reaction temperature of 30 to 80° C. Thereafter, the pigmented fibers recovered and further processed as desired.

It is a feature of the invention that the resulting pigmented fibers have brightness and light scattering abilities which have been improved, together with moderate gains in opacity. Further, the addition of pigment to fiber as in the process of paper filling provides improvements without the typical complexities of filler addition as is known to the art.

The following examples are presented to illustrate the invention but it is not to be considered as limited thereto. In the examples and throughout the specification, parts are by weight unless otherwise indicated.

EXAMPLE 1

Pigmented fiber is prepared by adding 15.2 g of silica/alumina sulfate sol (SASS) to 1000 g of bleached kraft fiber at 1.0% consistency and 65° C. The sol is added with agitation sufficient to disperse the sol throughout the fiber slurry. The mixture is digested for at least 15 minutes before recovering the pigmented fiber.

The pigmented fiber is dewatered to 3.0% consistency before being made down to 0.8% consistency. Using standard TAPPI methods, handsheets are prepared. The sheets are cut and calendared and allowed to equilibrate at 50% R.H. and 72° F. for 24 hours before measuring sheet brightness.

| | & ISO Brightness | % Ash |
|---|---|---|
| virgin fiber handsheet | 57.3 | 0.30 |
| example 1 pigmented fiber handsheet | 69.2 | 3.50 |

EXAMPLE 2

A series of treated pulp samples were prepared using SASS of the invention. To each sample of TMP based Newsprint were added between 0 and 0.23 g of Sol per gram of fiber (dry wt/wt). The samples were digested with agitation and recovered to produce handsheets as in Example 1.

SOL CONTENT vs BRIGHTNESS

| AMOUNT OF SOL g dry sol/g dry fiber | BASIS WT, $g/m^2$ | % ISO Brightness | % ASH |
|---|---|---|---|
| 0.00 | 49.24 | 59.40 | 0.50 |
| 0.06 | 49.18 | 60.25 | 0.63 |
| 0.02 | 47.91 | 61.10 | 1.16 |
| 0.17 | 48.21 | 62.27 | 1.98 |
| 0.23 | 48.31 | 65.01 | 3.24 |

EXAMPLE 3

A series of treated pulp samples were prepared using SASS. To each of three separate samples of kraft fiber were added 5.18 g, 10.35 g and 20.70 g of silica/alumina sulfate sol, respectively. The samples were digested with agitation and recovered to produce handsheets as in Example 1.

| | % ISO Brightness | % Ash |
|---|---|---|
| virgin fiber handsheet | 57.3 | 0.30 |
| 5.18 g SASS solution | 63.2 | 1.70 |
| 10.35 g SASS solution | 66.4 | 2.59 |
| 20.70 g SASS solution | 69.2 | 3.50 |

EXAMPLE 4

Using the methods described in Examples 1 and 2, a standard newsprint furnish containing 85% groundwood and 15% softwood bleached kraft was treated as described in Example 1.

| | % ISO Brightness | % Ash |
|---|---|---|
| virgin newsprint handsheet | 59.4 | 0.30 |
| 4.80 g SASS solution | 61.5 | 1.16 |
| 9.60 g SASS solution | 62.3 | 1.98 |
| 24.00 SASS solution | 66.1 | 3.83 |

EXAMPLE 5

Using the methods described in Examples 1 and 2 a series of sheets were prepared in which a series of complex silica/alumina, sulfate compounds were used to treat recycled newsprint fiber. Pulp samples were treated at a pH of 5 and at a sol addition of 0.37 g sol per gram of fiber (dry wt/wt).

| | % ISO Brightness | % ISO Opacity | % Ash |
|---|---|---|---|
| recycled newsprint handsheet | 58.2 | 88.5 | 1.44 |
| SASS as described in 5030284 | 63.4 | 92.5 | 4.23 |
| SASS as described in 0372715 | 63.7 | 92.7 | 4.87 |
| SASS as described in 5149400 | 60.4 | 91.4 | 2.20 |

FIGS. 1 and 2 accompanying the application are scanning electron micrograph (SEM) photographs which illustrate the characteristics of the products of the invention.

The invention has been described herein with reference to certain preferred embodiments. However, as obvious variations thereon will become apparent to those skilled in the art, the invention is not to be considered as limited thereto.

We claim:

1. A method for the production of a pigmented paper fiber having improved brightness and light scattering ability, the method comprising:

(a) forming a silica/alumina sulfate compound composition;

(b) adding said silica/alumina sulfate compound composition to a slurry of paper pulp fibers maintained at a temperature of about 30 to 80° C. with sufficient agitation to disperse the compound into the slurry;

(c) digesting the resulting reaction product; and (d) recovering the pigmented fibers.

2. A method according to claim 1, wherein about 0.1 to 10% (dry wt/dry wt) of said silica/alumina sulfate compound is added to said pulp slurry.

3. A method according to claim 1, wherein digestion of the reaction product is conducted by heating the pigmented fiber at a temperature of about 30 to 80° C. for about 5 minutes to 2 hours.

4. A method according to claim 1, wherein said silica/alumina sulfate compound is of the following formula:

$xR:Al_2O_3:ySiO_2:zSO_4:pH_2O$ where R is an alkali metal oxide or an alkaline earth metal oxide or mixture thereof,

| | | |
|---|---|---|
| x = 0 | to | 2.00 |
| y = 0.001 | to | 1.00 |
| z = 0 | to | 20.00 |
| p = 0 | to | 100 |

5. A method according to claim 1, wherein the paper pulp is kraft paper fiber, groundwood fiber, mechanical pulps and combinations thereof.

* * * * *

UNITED STATES PATENT AND TRADEMARK OFFICE

CERTIFICATE OF CORRECTION

PATENT NO. : 5,914,190

DATED : June 22, 1999

INVENTOR(S) : Withiam et al.

It is certified that error appears in the above-identified patent and that said Letters Patent is hereby corrected as shown below:

On the title page, item [54] and Column 1;

delete "ABD", and insert -- FOR -- therefor.

In Column 1, delete lines 62 through 67.

In Column 5, delete lines 13 through 15.

Signed and Sealed this

Fourteenth Day of December, 1999

*Attest:*

*Attesting Officer*

Q. TODD DICKINSON

*Acting Commissioner of Patents and Trademarks*